US007600857B2

(12) United States Patent
Kihara et al.

(10) Patent No.: US 7,600,857 B2
(45) Date of Patent: Oct. 13, 2009

(54) LIQUID DISCHARGE HEAD

(75) Inventors: Hiroki Kihara, Kawasaki (JP); Akihiko Shimomura, Yokohama (JP); Tadayoshi Inamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 428 days.

(21) Appl. No.: 11/610,809

(22) Filed: Dec. 14, 2006

(65) Prior Publication Data

US 2007/0139467 A1 Jun. 21, 2007

(30) Foreign Application Priority Data

Dec. 21, 2005 (JP) ..... 2005-368138

(51) Int. Cl.
*B41J 2/05* (2006.01)

(52) U.S. Cl. ..... 347/56; 347/63; 347/65

(58) Field of Classification Search ..... 347/20, 347/40, 44, 47, 56, 50, 58, 59, 61–65, 67
See application file for complete search history.

(56) References Cited

U.S. PATENT DOCUMENTS 6,328,423 B1 * 12/2001 Wong et al. ..... 347/50
6,565,187 B2 * 5/2003 Karita et al. ..... 347/29
6,834,937 B2 * 12/2004 Killmeier et al. ..... 347/50

FOREIGN PATENT DOCUMENTS

JP 61-125851 6/1986

* cited by examiner

*Primary Examiner*—Juanita D Stephens
(74) *Attorney, Agent, or Firm*—Fitzpatrick, Cella, Harper & Scinto

(57) ABSTRACT

A liquid discharge head includes a discharge element substrate including an energy generating element that generates energy for discharging liquid, a discharge port provided so as to correspond to the energy generating element, and a supply path for supplying the liquid to the discharge port. The discharge element substrate has an open face to which the discharge port is open, a back face of the open face, and side faces formed between the open face and the back face, and at least a part of the side faces is sealed by a sealing agent, which contains a filler made of fluororesin.

5 Claims, 6 Drawing Sheets

LIQUID DISCHARGE HEAD

BACKGROUND OF THE INVENTION

1. Field of the Invention

The present invention relates to a liquid discharge head for discharging liquid, and more particularly to an ink jet recording head that discharges ink to a recorded medium for performing recording.

2. Description of the Related Arts

Examples of using a liquid discharge head for discharging liquid include an ink jet recording method in which ink is discharged to a recorded medium for performing recording.

General ink discharging methods used for the ink jet recording method include a method in which an electrothermal transducing device such as a heater is used as a discharge energy generating element used for discharging an ink droplet, and a method in which a piezoelectric device such as a piezoelectric element is used. Both methods can control the discharge of ink droplet by an electrical signal.

The ink jet recording head is mounted to a recording apparatus in such a manner that the surface of its discharge port is opposite to the recorded medium. Some of the recording apparatuses have a configuration in which scanning is made inside of the recording apparatus according to the conveyance of the recorded medium, while some of the recording apparatuses include recording means over a whole range of a recording width of the recorded medium.

There have widely been known an ink jet recording head having formed on a substrate discharging means such as an ink discharging energy generating element, ink flow path, a discharge port, and the like. Si is often used as a normal substrate, and the recording head is fabricated by forming recording means on the substrate made of Si and cut by a dicing method or the like.

Meanwhile, the cutting face cut by the dicing cut is likely to be chemically affected. Therefore, in order to prevent the exposure of the cutting face, there has been known a method for protecting an element substrate from various external factors such as ink by applying sealing agent (hereinafter referred to as chip-side sealing agent) on the outer periphery of the substrate.

On the other hand, until the ink jet recording head is brought into a used state, means for protecting the discharge port is taken for preventing the clogging of ink filled inside or dryout of the ink in the vicinity of the discharge port, or intrusion of dust, etc., into the discharge port.

As the protecting means described above, a method disclosed in Japanese Patent Application Laid-Open No. S61-125851 has been known in which a sealing member having adhesive component laminated on a base is attached, as a tape (hereinafter referred to as "sealing tape"), so as to cover all over the surface of the discharge port.

The sealing tape is attached on the entire region of the discharge port over the chip-side sealing agent.

However, since the chip-side sealing agent described above generally has adhesiveness, only the base of the tape is peeled off due to the adhesiveness of the chip-side sealing agent when the sealing tape is peeled off in the use of a product, whereby it is feared that the adhesive layer of the tape remains on the chip-side sealing agent. The adhesive layer remaining on the chip-side sealing agent moves from the chip-side sealing agent to the discharge port during the restoring operation of discharge such as a wiping on the surface of the discharge port, thereby entailing a problem of clogging the discharge port.

SUMMARY OF THE INVENTION

A liquid discharge head according to the present invention comprises: a discharge element substrate including an energy generating element that generates energy for discharging liquid, a discharge port provided so as to correspond to the energy generating element, and a supply path for supplying the liquid to the discharge port; wherein the discharge element substrate has an open face to which the discharge port is open, a back face of the open face, and a side face formed between the open face and the back face, and at least a part of the side face is sealed by a sealing agent, wherein the sealing agent contains a filler made of fluororesin.

In the ink jet recording head according to the present invention, fluororesin is added to the chip-side sealing agent of the discharge element substrate, whereby the occurrence of the remaining adhesive layer of the tape can be reduced when the sealing tape used for protecting the discharge port is peeled off. Therefore, the present invention can stably provide a high-quality ink jet recording head.

Further features of the present invention will become apparent from the following description of exemplary embodiments with reference to the attached drawings.

DESCRIPTION OF THE EMBODIMENTS

Figure 1:
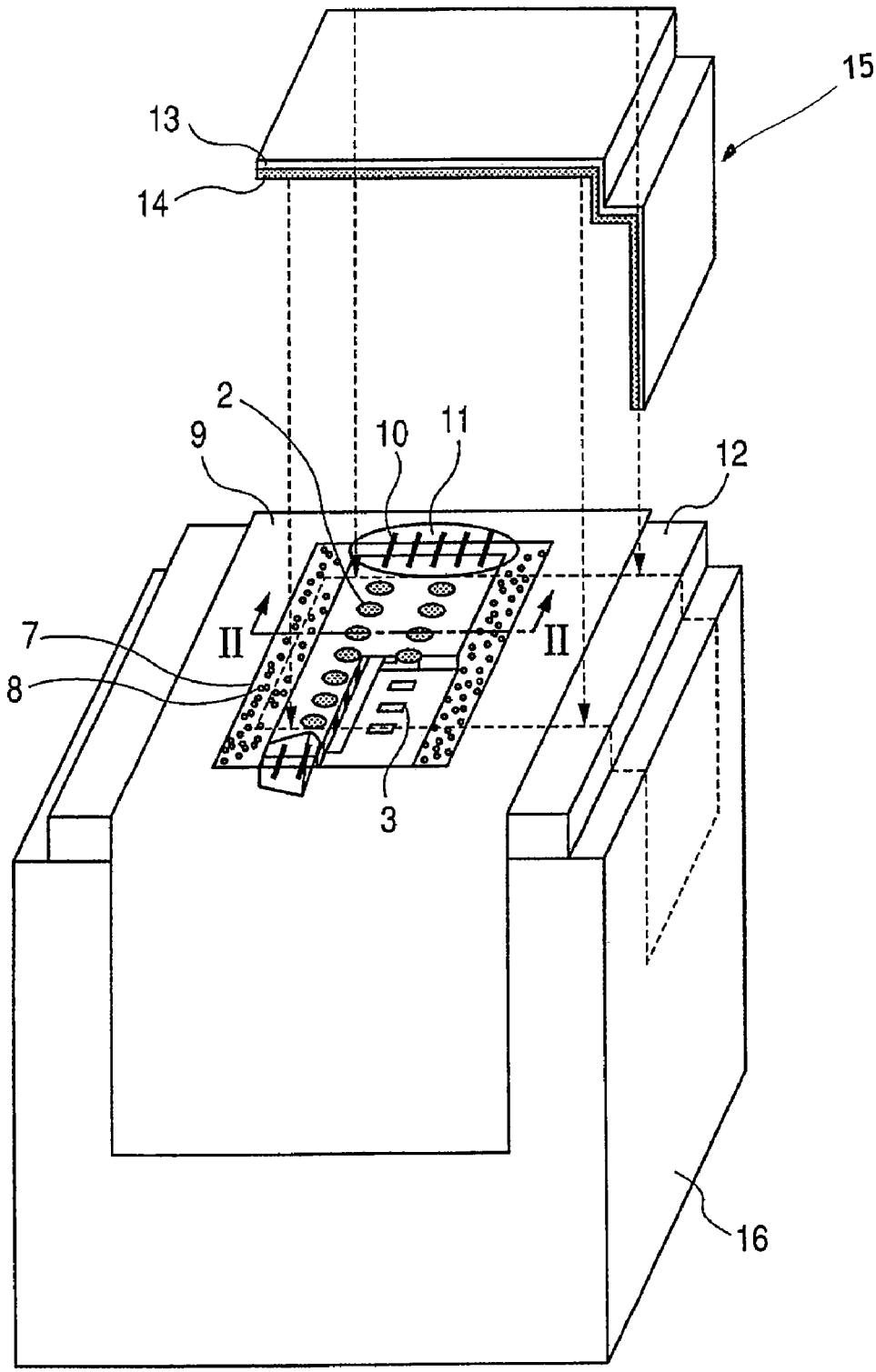
FIG. 1 is a schematic perspective view showing an ink jet recording head according to one embodiment of the present invention.

An embodiment of the present invention will be explained below while referring to the drawings. In the following explanation, the components having the same function are identified by the same numerals in the figures, and the explanation thereof is sometimes omitted.

The explanation describes an ink jet recording system as an application example of the present invention, but the applicable range of the present invention is not limited thereto.

Firstly, an ink jet recording head (hereinafter referred to as "recording head") to which the present invention is applicable will be explained.

Figure 2:
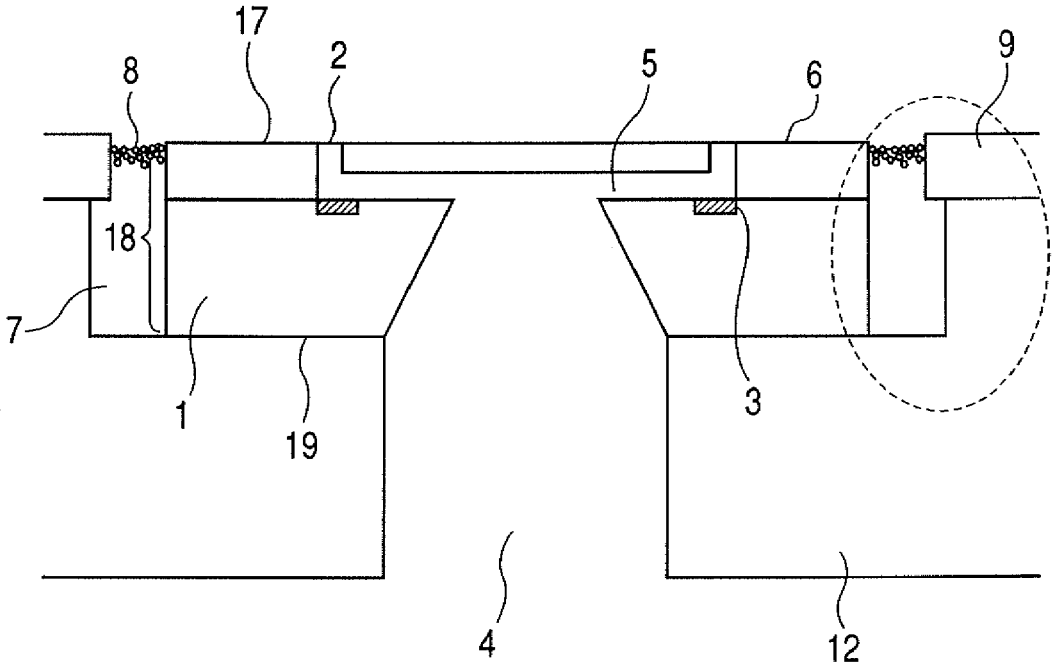
FIG. 2 is a schematic sectional view showing an ink jet recording head according to one embodiment of the present invention.
Figure 3A:
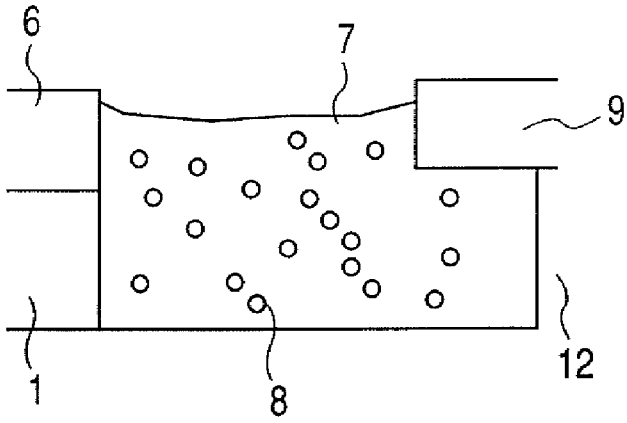
FIGS. 3A, 3B and 3C are schematic sectional views showing one example of a manufacturing process of an ink jet recording head according to one embodiment of the present invention.
Figure 3B:
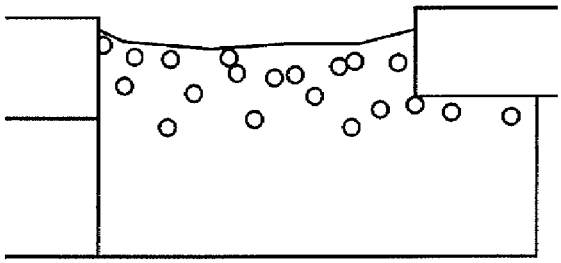
Figure 3C:
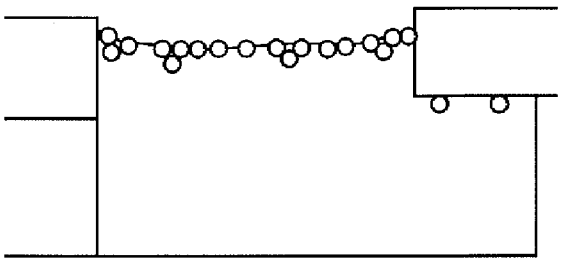

FIG. 1 is a schematic perspective view of a recording head according to one embodiment of the present invention. FIG. 2 is a schematic sectional view showing an element substrate and its surroundings of the recording head according to one embodiment of the present invention, which is a sectional view taken along a line II-II in FIG. 1. FIGS. 3A to 3C are schematic sectional views showing the element substrate and a portion of chip-side sealing agent in the recording head according to one embodiment of the present invention as enlarged at the portion corresponding to the dotted frame in FIG. 2. FIGS. 4A to 4F are views for showing a manufacturing method of the recording head according to one embodiment of the present invention.

As shown in FIGS. 1 and 2, the recording head according to the present invention has a discharge element substrate 1, which is provided with a discharge port for discharging ink, and is fixed to a support member 12. An energy generating element 3 that is used for discharging ink and generates energy is formed on the discharge element substrate 1 so as to correspond to the discharge port 2. Supply paths 4 and 5 for supplying ink to each discharge port 2 are formed. A chip sheet 12 as a support member is fixed to a holder 16 serving as a connection member to the recording apparatus. The support member and the connection member may be integrally formed. A chip-side sealing agent 7 is filled between the chip plate 12 and the element substrate 1 in order to protect the outer periphery of the element substrate 1.

Epoxy resin, oxetane resin, and the like are used for the chip-side sealing agent. Known materials described above include the one in which curing reaction is started and progressed by applying energy such as ultraviolet ray or heat, the one in which a specific chemical substance advances the curing reaction, and the like.

A lead wiring 10 for transmitting a drive signal from an electric wiring member 9 is connected to the element substrate 1. In order to protect the lead wiring 10, a sealing process is performed with the use of a lead sealing agent 11.

Before the recording head is used, a sealing tape 15 for protecting the discharge port 2 is attached to the element substrate 1, chip-side sealing agent 7 and electric wiring member 9. The sealing tape 15 is constituted by, for example, a base 13 and an adhesive layer 14. Acrylic resin or the like is generally used for the adhesive layer. The thickness of the adhesive layer is, in most cases, approximately 5 to 50 μm. In a normal packaged state, the adhesive agent 14 is attached so as to cover the discharge port, and also comes in contact with the chip-side sealing agent at the section other than the discharge element substrate.

As shown in FIG. 2, in the recording head according to the present invention, all of or a part of side faces 18 formed between an open face 17 to which the discharge port 2 is open and a back face 19 are sealed by the chip-side sealing agent 7. The side faces 18 are not always flat, but they may include curved portions. Specifically, the side faces 18 are faces communicating with the open face 17 and the back face 19 and exposed outward of the discharge element substrate 1.

In the recording head according to the embodiment of the present invention, the fluororesin filler 8 in the chip-side sealing agent 7 is segregated in the direction toward the surface of the discharge port. Namely, it means that a density of the filer is biased in the fluororesin of the sealing agent and the density in a direction toward the discharge port surface is relatively higher than other portion. The segregation is not necessary in the invention and the density of filler may be equal in the fluororesin of the searing agent. Since the fluororesin filler has low affinity to the adhesive agent used for a tape, the adhesive strength of the tape with respect to the sealing agent decreases. Further, in case where the filler is segregated in the direction toward discharge port surface, the adhesive strength at the portion of the chip-side sealing agent 7 where the filler is segregated is even more reduced. Therefore, the adhesiveness of the sealing tape to the adhesive agent is reduced at the portion of the chip-side sealing agent, whereby the remaining adhesive agent on the surface of the sealing agent is reduced when the sealing tape is peeled off.

Here, any one of fluororesin filler having a fluorine atom and currently known as a filler can be used without imposing any limitations. Particularly, the fluororesin filler having perfluoro alkyl group is preferable. For example, polytetrafluoroethylene or ethylene-tetrafluoroethylene copolymer can preferably be used. The particle diameter is not particularly limited, but the particle diameter of 100 μm or smaller is especially preferable. It is preferable that the fluororesin filler is contained in the chip-side sealing agent in an amount of 10 to 30 wt. %. The commercially available fluororesin filler includes, for example, Fluon PTFE G100 series (manufactured by Asahi Glass Co., Ltd.).

FIGS. 3A to 3C are explanatory views of a schematic process flow of the application and heat curing of the chip-side sealing agent 7 in the ink jet recording head according to the embodiment of the present invention. FIGS. 3A to 3C are enlarged views of the portion encircled by a dotted frame in FIG. 2.

As shown in FIG. 3A, the chip-side sealing agent 7 containing the fluororesin filler 8 is filled in the space between the element substrate 1 and the chip plate 12.

Subsequently, as shown in FIG. 3B, the fluororesin filler 8 is floated and segregated on the surface of the chip-side sealing agent 7 during the process for heat-curing the chip-side sealing agent 7.

Next, as shown in FIG. 3C, the fluororesin filler 8 is floated to the surface of the chip-side sealing agent after the heat-curing of the chip-side sealing agent 7, whereby the surface becomes irregular.

Therefore, even if the sealing tape 15 is attached, the contact area between the chip-side sealing agent 7 and the tape is reduced. Since the fluororesin filler is used as filler, the adhesion to the sealing tape 15 can be suppressed due to the non-adhesiveness of the fluororesin. Accordingly, the remaining of the adhesive layer 14 of the tape on the chip-side sealing agent upon releasing the tape can be suppressed.

The above-mentioned segregation method is described for purpose of illustration only. A method in which magnetism is applied to the filler and the segregation is made by forming a magnetic field, or a method in which the segregation is made by using electric field, can be employed, depending upon the situation.

The position to which the sealing tape is attached is optional depending upon the packing condition. The sealing tape may be attached to the lead sealing agent, depending upon the situation. In this case, the fluororesin filler can be contained in the lead sealing agent, not in the chip-side sealing agent.

The present invention will be explained in more detail with reference to examples.

EXAMPLE 1

A recording head was manufactured and evaluation was carried out.

FIGS. 4A to 4F are views showing a manufacturing process of the recording head, seen from the discharge port 2 toward the support member 12, according to one embodiment of the present invention.

Figure 4A:
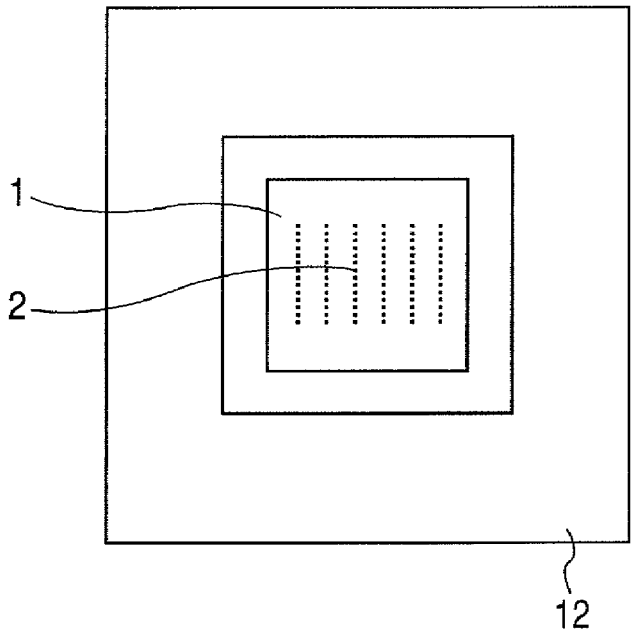
FIGS. 4A, 4B, 4C, 4D, 4E and 4F are schematic views showing an ink jet recording head according to one embodiment of the present invention.

FIG. 4A shows a state in which the discharge element substrate 1 having mounted thereon the discharge port 2 and the energy generating element 3 (not shown) and the support member are bonded to each other.

Figure 4B:
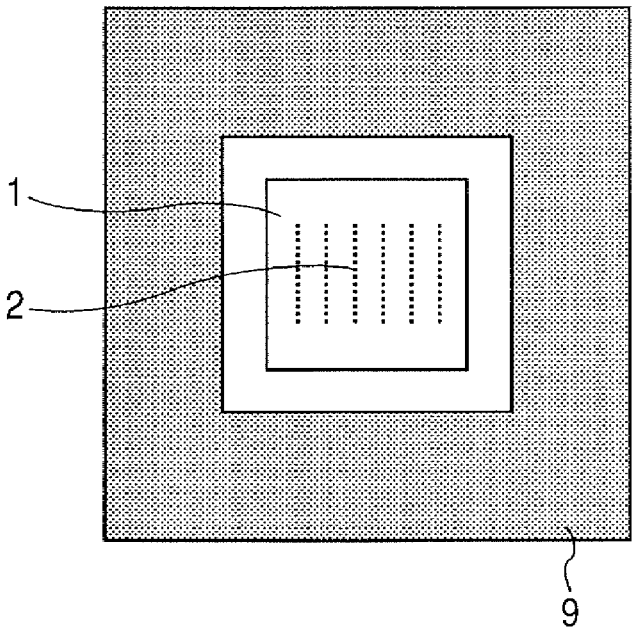

Then, as shown in FIG. 4B, a positioning is carried out in such a manner that the discharge element substrate is put into a removed portion of the electric wiring member 9 having a portion partly removed (died), and the electric wiring member 9 was bonded to the support member 12.

Figure 4C:
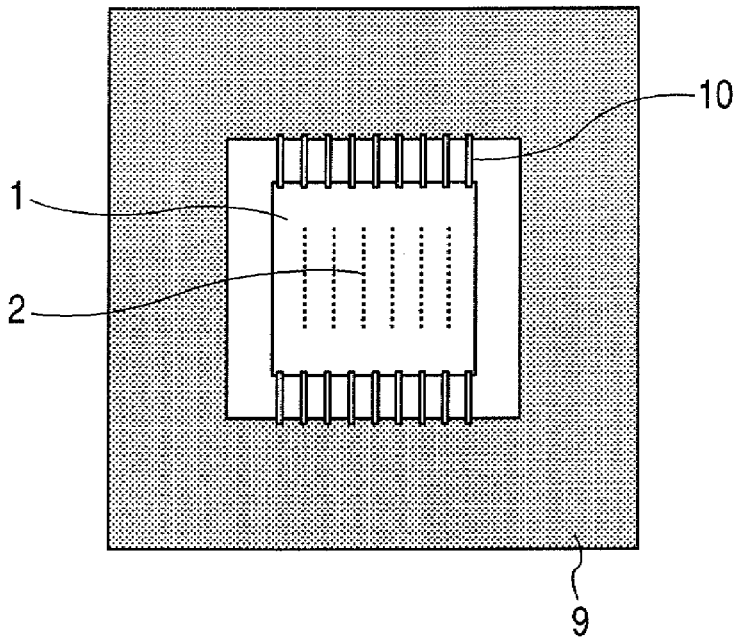

Then, as shown in FIG. 4C, the leads 10 were electrically connected to the discharge element substrate 1

Figure 4D:
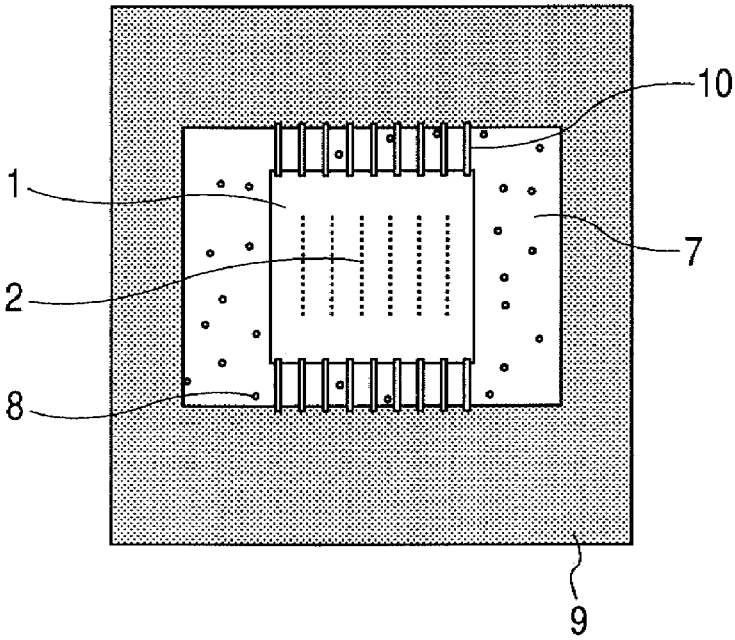

Next, as shown in FIG. 4D, the chip-side sealing agent 7 was poured into the periphery of the discharge element substrate 1, thereby sealing the space between the discharge element substrate 1 and the support member 12, the portion between the discharge element substrate 1 and the electric wiring member 9, and the outer periphery of the discharge port. In this case, the sealing agent obtained by mixing fluororesin fillers Fluon PTFE G100 series (manufactured by Asahi Glass Co., Ltd.) in epoxy resin based sealing agent (EP-171 manufactured by Cemedine Co., Ltd.) was used as the chip-side sealing agent 7.

Figure 4E:
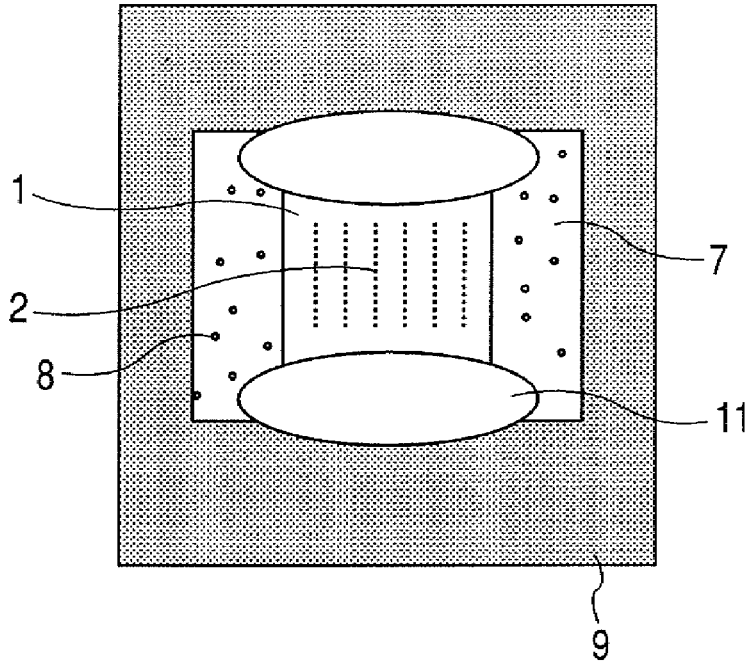

Subsequently, as shown in FIG. 4E, the lead sealing agent 11 was applied on the leads 10.

Figure 4F:
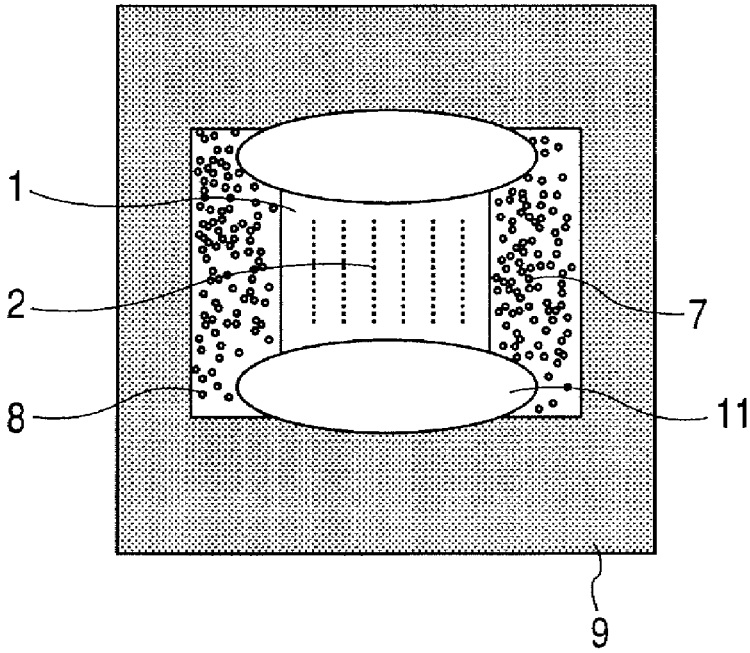

Next, as shown in FIG. 4F, heat is applied for curing the chip-side sealing agent 7 and the lead sealing agent 11, whereby the fluororesin fillers were segregated.

Thereafter, a tape having acryl-based adhesive agent was attached over the chip-side sealing agent 7 and the face of the discharge element substrate 1 to which the discharge port 2 was formed in order to seal the face of the discharge port.

The obtained recording head was left for three months under 60° C., and the surface of the chip-side sealing agent 7 was observed by a microscope after the sealing tape was peeled off. As a result of the observation, the remaining adhesive agent was not found.

Comparative Example 1

A recording head was manufactured in the same manner as in the example 1 except that the chip-side sealing agent 7 not containing the fluororesin fillers was used. As in the example 1, a tape was attached and the obtained recording head was left for three months under 60° C., and the surface of the chip-side sealing agent 7 was observed after the sealing tape was peeled off. As a result of the observation, the remaining adhesive agents were found. When the recording head was mounted to a recording apparatus to perform a test print, poor discharge was observed in part after the wiping. As a result of the detailed analysis, it was found that some adhesive agent remained on the surface of the discharge port.

Comparative Example 2

A recording head was manufactured in the same manner as in the example 1 except that silica was contained in the chip-side sealing agent 7 as a filler. Even when heat was applied for curing the chip-side sealing agent 7 and the lead sealing agent 11, the silica filler were was not segregated on the surface of the chip-side sealing agent. As in the example 1, a tape was attached and the obtained recording head was left for three months under 60° C., and the surface of the chip-side sealing agent 7 was observed after the sealing tape was peeled off. As a result of the observation, the remains of adhesive agent were found. When the recording head was mounted to a recording apparatus to perform a test print, poor discharge was observed in part after the wiping. As a result of the detailed analysis, it was found that the remaining adhesive agent was deposited on the surface of the discharge port.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Application No. 2005-368138, filed Dec. 21, 2005, which is hereby incorporated by reference herein in its entirety.

What is claimed is:

1. A liquid discharge head comprising:

a discharge element substrate including an energy generating element that generates energy for discharging liquid, a discharge port provided so as to correspond to the energy generating element, and a supply path for supplying the liquid to the discharge port, wherein the discharge element substrate has an open face to which the discharge port is open, a back face of the open face, and a side face formed between the open face and the back face, and at least a part of the side face is sealed by a sealing agent, wherein the sealing agent contains a filler made of fluororesin, and wherein the filler is segregated in the sealing agent in the direction toward the open face from the back face.

2. A liquid discharge head according to claim 1, wherein the sealing agent is made of a thermosetting resin.

3. A liquid discharge head comprising:

a discharge element substrate including an energy generating element that generates energy for discharging liquid, a discharge port provided so as to correspond to the energy generating element, and a supply path for supplying the liquid to the discharge port.

wherein the discharge element substrate has an open face to which the discharge port is open, a back face of the open face, and a side face formed between the open face and the back face, and at least a part of the side face is sealed by a sealing agent.

wherein the sealing agent contains a filler made of fluororesin, and wherein a sealing tape for covering the discharge port covers the open face of the discharge element substrate and is attached to the sealing agent.

4. A liquid discharge head according to claim 3, wherein the sealing agent is made of a thermosetting resin.

5. A liquid discharge head comprising:

a discharge element substrate including an energy generating element that generates energy for discharging liquid, a discharge port provided so as to correspond to the energy generating element, and a supply path for supplying the liquid to the discharge port; and a sealing tape for covering the discharge port, wherein the discharge element substrate has an open face to which the discharge port is open, a back face of the open face, and a side face formed between the open face and the back face, and at least a part of the side face is sealed by a sealing agent, the sealing agent contains a filler made of fluororesin, the filler is segregated in the direction toward the open face from the back face, and the sealing tape covers the open face of the discharge element substrate and is attached to the sealing agent.

* * * * *